US008052011B2

(12) United States Patent
Tam et al.

(10) Patent No.: US 8,052,011 B2
(45) Date of Patent: Nov. 8, 2011

(54) APPARATUS AND METHOD FOR DISPENSING BAGS

(76) Inventors: Doron Tam, Tel-Aviv (IL); Ari Bichler, Ramat Gan (IL); Yossi Bichler, Kfar-Saba (IL)

( * ) Notice: Subject to any disclaimer, the term of this patent is extended or adjusted under 35 U.S.C. 154(b) by 377 days.

(21) Appl. No.: 10/580,289

(22) PCT Filed: Nov. 24, 2004

(86) PCT No.: PCT/IL2004/001078

§ 371 (c)(1),
(2), (4) Date: May 24, 2006

(87) PCT Pub. No.: WO2005/051774

PCT Pub. Date: Jun. 9, 2005

(65) Prior Publication Data

US 2007/0051744 A1 Mar. 8, 2007

(30) Foreign Application Priority Data

Nov. 27, 2003 (IL) ..... 159079

(51) Int. Cl.
*B65H 3/02* (2006.01)

(52) U.S. Cl. ..... 221/256; 221/9; 221/43; 221/259; 221/277; 221/279

(58) Field of Classification Search ..... 221/256, 221/259, 33, 39, 42, 43, 51, 105, 113, 119, 221/222, 210, 1, 2, 4, 5, 8, 9, 13, 18, 22, 221/26, 34, 36, 58, 59, 60, 74, 7, 77, 78, 221/92, 151, 153, 208, 209, 217, 218, 220, 221/231, 235, 239, 251, 254, 255, 257, 258, 221/260, 261, 262, 277, 279, 280; 186/61; 194/10; 242/559.1; 53/573, 29, 571, 384.1
See application file for complete search history.

(56) References Cited

U.S. PATENT DOCUMENTS 410,045 A * 8/1889 Tabour ..... 221/23
444,502 A * 1/1891 Mosler ..... 194/262
800,072 A * 9/1905 Churchman et al. ..... 194/298
(Continued)

FOREIGN PATENT DOCUMENTS

DE 4034863 A1 * 5/1992

OTHER PUBLICATIONS

International Search Report for International Application No. PCT/IL04/001078, International Filing Date Nov. 27, 2003.

*Primary Examiner* — Gene Crawford
*Assistant Examiner* — Kelvin Randall, Jr.
(74) *Attorney, Agent, or Firm* — Deborah Gador

(57) ABSTRACT

A device and method for dispensing a bag from a stack of bags, the device including a plate having a frame, a rotatable shaft coupled to the frame, at least one roller non-rotatably affixed to the shaft and arranged to engage a bag of the stack of bags, means for rotating the shaft, and means for automatically stopping rotation of the shaft after a single bag has been dispensed, wherein the stack of bags is held against one side of the plate, and the single bag is dispensed to an opposite side of the plate.

9 Claims, 15 Drawing Sheets

U.S. PATENT DOCUMENTS

| | | | | | |
|---|---|---|---|---|---|
| 803,343 | A | * | 10/1905 | Hoyt | 221/43 |
| 1,190,661 | A | * | 7/1916 | Marker | 221/26 |
| 1,312,449 | A | * | 8/1919 | Lundberg | 221/23 |
| 1,659,167 | A | * | 2/1928 | Schultz | 221/98 |
| 1,913,722 | A | * | 6/1933 | Perrin | 225/16 |
| 1,918,460 | A | * | 7/1933 | Eccardt | 221/23 |
| 1,988,732 | A | * | 1/1935 | Hawley | 221/55 |
| 2,021,659 | A | * | 11/1935 | Judkins | 312/50 |
| 2,396,411 | A | * | 3/1946 | Cameron | 221/39 |
| 2,623,761 | A | * | 12/1952 | Condon | 462/10 |
| 3,154,216 | A | * | 10/1964 | Snow et al. | 221/231 |
| 3,168,212 | A | * | 2/1965 | Edwards | 221/39 |
| 3,269,590 | A | * | 8/1966 | Harter | 221/23 |
| 3,503,481 | A | * | 3/1970 | Brenner | 194/240 |
| 3,586,207 | A | * | 6/1971 | Brenner | 221/259 |
| 3,674,176 | A | * | 7/1972 | Sagi | 221/135 |
| 3,684,278 | A | * | 8/1972 | Takahaski | 271/281 |
| 3,685,691 | A | * | 8/1972 | Charest et al. | 221/225 |
| 3,754,370 | A | * | 8/1973 | Hanson | 53/459 |
| 4,032,038 | A | * | 6/1977 | Hendricks et al. | 221/71 |
| 4,043,484 | A | * | 8/1977 | Vanjo | 221/213 |
| 4,296,873 | A | * | 10/1981 | Schlumpf | 221/213 |
| 4,473,172 | A | * | 9/1984 | Reynolds | 221/213 |
| 4,509,738 | A | * | 4/1985 | Aoki | 271/160 |
| 4,738,384 | A | * | 4/1988 | Tigner | 225/16 |
| 4,781,305 | A | * | 11/1988 | Carberry | 221/23 |
| 4,802,606 | A | * | 2/1989 | Daniels | 221/39 |
| D300,892 | S | * | 5/1989 | McCrory | D6/518 |
| 4,912,906 | A | * | 4/1990 | Toner | 53/463 |
| 5,167,301 | A | * | 12/1992 | Cappi et al. | 186/66 |
| 5,249,787 | A | * | 10/1993 | Ifkovits | 271/6 |
| 5,492,398 | A | * | 2/1996 | Schafer | 312/34.7 |
| 5,601,281 | A | * | 2/1997 | Kubodera et al. | 271/10.04 |
| 5,641,039 | A | * | 6/1997 | Dumont | 186/61 |
| 5,833,230 | A | * | 11/1998 | Nakagawa et al. | 271/121 |
| 5,890,344 | A | * | 4/1999 | Smith et al. | 53/447 |
| 6,006,495 | A | * | 12/1999 | Varichon et al. | 53/384.1 |
| 6,149,256 | A | * | 11/2000 | McIntyre et al. | 347/2 |
| 6,155,456 | A | * | 12/2000 | Archer | 221/231 |
| 7,484,640 | B2 | * | 2/2009 | von Falkenhausen et al. | 221/231 |
| 7,735,994 | B2 | * | 6/2010 | Silverbrook | 347/108 |
| 2001/0032859 | A1 | * | 10/2001 | Coleman | 221/213 |
| 2002/0117578 | A1 | * | 8/2002 | Denen et al. | 242/563 |
| 2004/0082454 | A1 | * | 4/2004 | White et al. | 493/189 |
| 2007/0176349 | A1 | * | 8/2007 | Gerlier et al. | 271/10.03 |

* cited by examiner

APPARATUS AND METHOD FOR DISPENSING BAGS

FIELD OF THE INVENTION

The present invention relates to devices for dispensing bags in general and, in particular, to devices for dispensing one single plastic bag at a time in stores and shopping areas.

BACKGROUND OF THE INVENTION

Bags have been utilized for packaging store-bought goods for many years. In places where trees are plentiful, paper bags are utilized, which are easily separated from one another for use as needed. In other areas, plastic bags are preferred. These bags are packaged in stacks of flattened bags, or are sold as perforated sheets rolled about a core.

Regardless of the type or design of the bags used, the bags themselves are costly, so it is preferable to the storeowner that each customer take only as many bags as needed for his or her purchases. In particular, at present many customers take home a number of empty plastic bags for a variety of personal uses, in addition to those needed to wrap the customer's purchases. Furthermore, since plastic bags do not degrade, the billions and billions of plastic bags thrown away today are clogging up the land, the drains, the rivers, and the seas, and creating a severe, world-wide environmental problem. In order to solve this problem, some countries, like Ireland, have begun collecting taxes for each plastic bag taken from stores. In other areas, stores have begun charging customers for the bags they use or take away. Yet another solution is biodegradable plastic bags, although these are expensive to produce and have so far proved unsatisfactory in use.

Furthermore, since the bags are generally of plastic film, it is often difficult to open them. They usually must be crumpled or one side rubbed against the other, in order to open them. In order to solve this problem, an automatic bag dispenser was disclosed in U.S. Pat. No. 6,006,495. This device is located adjacent the cash register, under a conveyor or shelf, and includes two parallel rollers arranged to rotate in opposite directions and to engage a single bag between them, thereby folding the bag and removing it from the stack. The bottom of the bag, which is engaged first, is passed through a slot into a container, where one side of the bag remains held by the device. This permits the other side of the bag to be grabbed and the bag opened for filling with groceries.

Another approach was suggested in Japanese Patent No. 05-151439, which discloses a bag dispensing machine which dispenses one bag at a time. This Japanese patent describes a device including housing for holding a stack of bags having two side handles and a central frangible portion having a through-going hole for hanging the bags. The bags are hung by this hole on an elongate hook in the housing, and pressed by one or two spring-biased plates against a roller coupled by a belt to a motor in the housing. When a bag is to be dispensed, the motor causes the roller to rotate, thereby pulling the front-most bag from the stack, which falls against a pivoting door, for removal by a shopper. The motor is arranged to drive the driveshaft for a predetermined number of rotations.

This machine suffers from a number of disadvantages. First, the motor is operated for a predetermined number of rotations, but there is no automatic way to ascertain whether a bag (or more than one bag) has actually been pulled down by the roller. In other words, no control mechanism is provided to ensure that one bag, and only one bag, has been dispensed. Second, in the embodiment of FIG. 1, at least, the customer has access to the entire stack of the bags, since the door for bag removal is located adjacent the bag stack, and can remove as many bags as desired. In addition, the user can pull the bag before it has been completely dispensed, thereby interfering with operation of the device, which could cause malfunction. Third, there is nothing to prevent the removed bag from inadvertently winding about the roller and becoming entangled. Fourth, the device has no indication whether a user has actually removed a dispensed bag. Thus, an instruction can be received for dispensing a further bag, and the machine will dispense another bag, even though a bag is already available.

Accordingly, there is a long felt need for a bag dispensing device which dispenses only one bag at a time and includes a control unit for controlling the number and rate of bags dispensed, and it would be very desirable to have such a device wherein the customer has no access to the stack of bags, but only to the dispensed bag or bags.

SUMMARY OF THE INVENTION

The present invention provides a bag dispensing device, which dispenses a single bag at a time, and which includes a control mechanism to prevent removal of a further bag before the previous bag has been taken from the device. In this way, the number of bags taken can be monitored and controlled.

There is thus provided, is accordance with the present invention, a device for dispensing a bag from a stack of bags, the device including a plate having a frame, a rotatable shaft coupled to the frame, at least one roller non-rotatably affixed to the shaft and arranged to engage a bag of the stack of bags, a member for rotating the shaft, and an element for automatically stopping rotation of the shaft after a single bag has been dispensed, wherein the stack of bags is held against one side of the plate, and the single bag is dispensed to an opposite side of the plate.

According to one embodiment, the rotatable shaft is mounted on the frame and the device also includes a bag retaining element coupled to the plate for pressing the stack of bags against the roller. According to another embodiment, the rotatable shaft is mounted on a bag retaining element coupled to the plate for pressing the stack of bags against the rollers.

According to a preferred embodiment the element for automatically stopping includes a dispensed bag detector adapted to stop rotation of the shaft in response to detection of a dispensed bag.

According to a preferred embodiment of the invention, the rotating means includes a motor and a transmission coupling the motor to the rotatable shaft such that the motor drives the shaft. Preferably, the element for stopping includes a dispensed bag detector coupled to the motor and adapted to stop rotation of the motor in response to detection of a dispensed bag.

Further according to a preferred embodiment, the device further includes a second rotatable shaft mounted parallel to the rotatable shaft on an extension of the frame, and at least one roller non-rotatably affixed to the second shaft, wherein each roller on the rotatable shaft is coupled to a roller on the second shaft, whereby rotation of the rotatable shaft causes concomitant rotation of the second shaft According to another embodiment of the invention, the device further includes an electronic connection for coupling to a cash register for communication therewith.

According to yet another embodiment, the device further includes a display mounted on the outside of the housing, for displaying advertising or other messages. Preferably, the display is coupled to a computerized controller, and may be coupled to the central computer of the store where it is used.

There is also provided in accordance with the present invention a method for dispensing a bag from a stack of bags, the method including holding a stack of bags against at least one roller non-rotatably affixed to a rotatable shaft coupled to a plate having a frame, dispensing one bag from the stack of bags to an opposite side of the plate from the stack of bags by rotating the rotatable shaft, and automatically stopping rotation of the shaft after dispensing a single bag.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a device for dispensing plastic bags, one at a time, for use in stores and shopping areas. The device dispenses a single bag at a time and can be coupled to a cash register or other controller for control of the total number of bags dispensed to each customer. If desired, the rate at which the bags are dispensed can also be set and controlled. According to one embodiment, the device can also hold advertising material or other informational or aesthetic displays.

Figure 1:
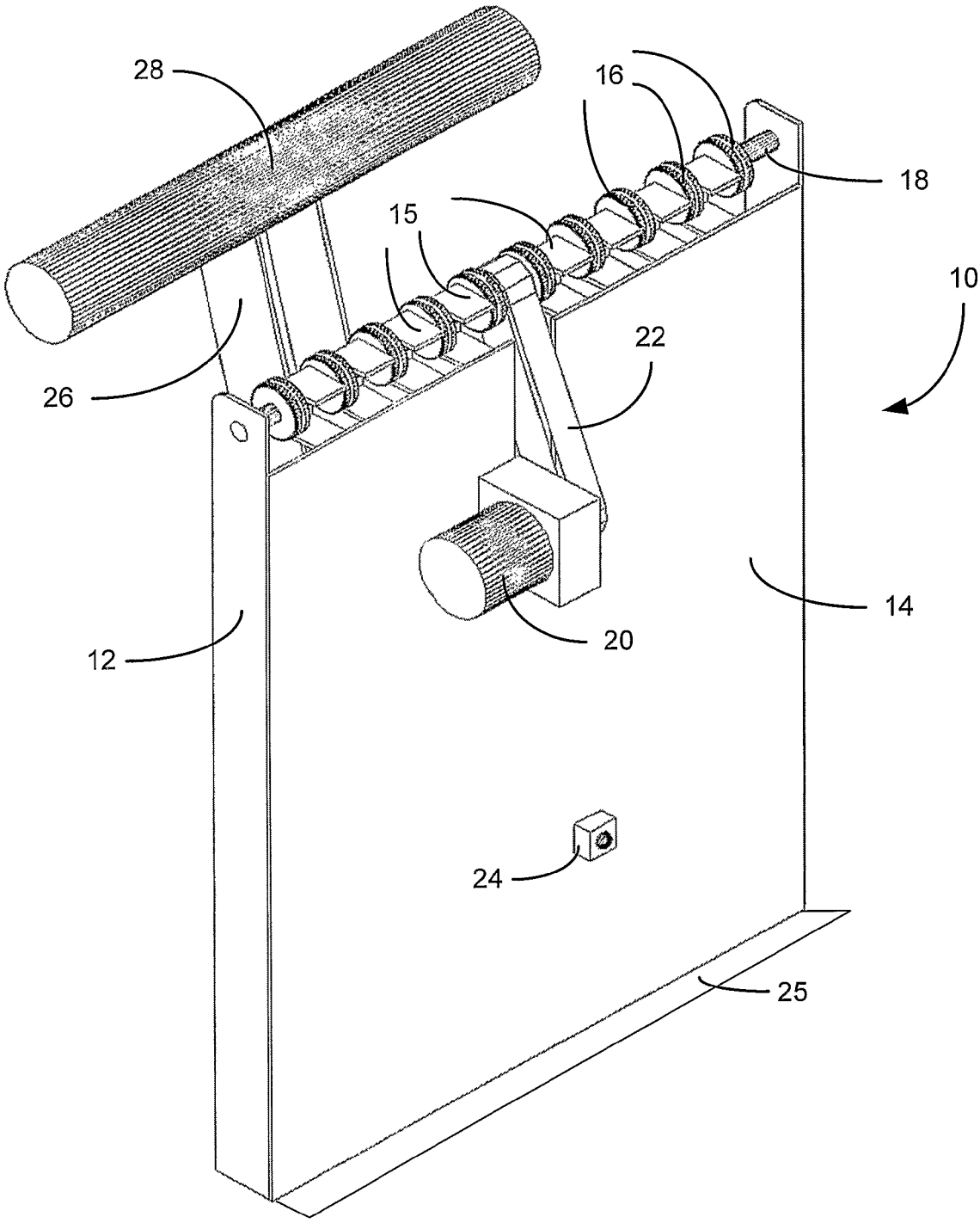
FIG. 1 is a schematic front view illustration of a device for dispensing bags constructed and operative in accordance with one embodiment of the present invention.
Figure 2:
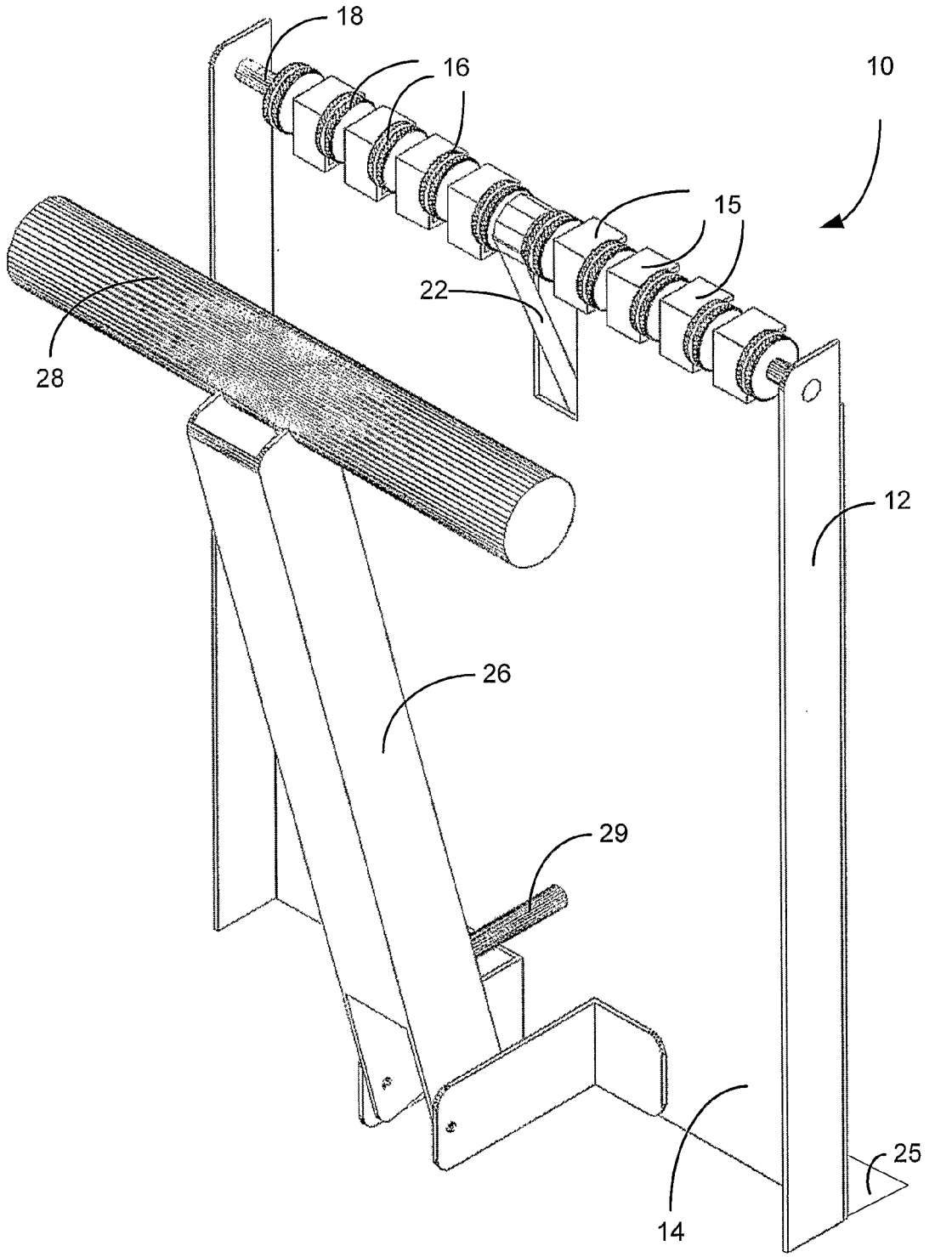
FIG. 2 is a schematic rear view of the device of FIG. 1, in a bag receiving orientation.

Referring now to FIGS. 1 and 2, there are shown schematic front and rear view illustrations of a device 10 for dispensing bags, constructed and operative in accordance with one embodiment of the present invention. Bag dispensing device 10 includes a frame 12 on which is mounted a plate 14. The rear surface of plate 14 serves as a planar bag-supporting surface. At least one, and preferably a plurality of rollers 16 are non-rotatably affixed to a shaft 18, which is rotatably mounted on top of frame 12. According to one embodiment, spacers 15 are provided between the rollers to keep the dispensed bags distanced from the rollers, so the bags don't become entangled in the rollers.

Means for rotating shaft 18 is provided on the device. In the embodiment of FIGS. 1 and 2, the means for rotating shaft 18 is a motor 20 mounted on the front surface of plate 14. Shaft 18 is driven by motor 20 by a power transmission means 22, such as a belt. A detector 24, such as an electric eye, is also mounted on the front surface of plate 14, in order to detect the presence of a bag adjacent to the detector. Alternatively, detector 24 can be any other detection means, such as a weight-sensitive switch coupled to a bottom plate 25 coupled to the frame, onto which the dispensed bag falls, or a capacitative sensor.

Figure 10:
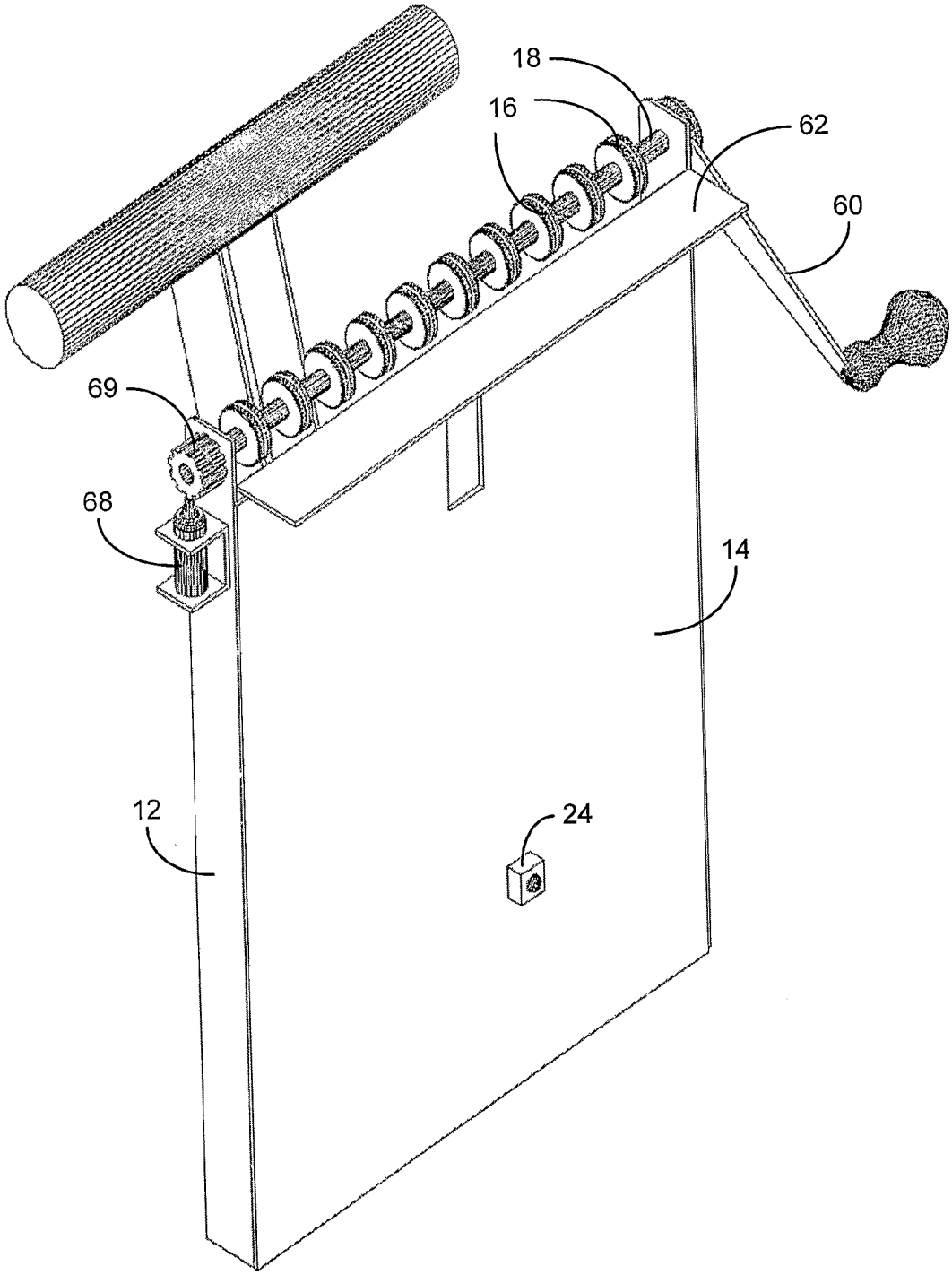
FIG. 10 is a schematic view of a device for dispensing bags constructed and operative in accordance with another embodiment of the present invention.

According to an alternative embodiment, shown in FIG. 10, the means for rotating shaft 18 can be a handle 60, or any other manual means of causing rotation of shaft 18. In this case, electromechanical means are provided for causing the shaft 18 to stop rotating after dispensing a single or desired number of bags.

Pivotally mounted on the rear surface of plate 14 is a bag-retaining arm 26, preferably spring-biased in a closed orientation, for holding a stack of bags against the plate. In FIG. 2, arm 26 is shown in an open orientation for receiving a stack of bags. A bar 28 is mounted on the end of arm 26, substantially adjacent the row of rollers, or slightly higher, when in the closed orientation. Bar 28 serves to press the bottoms (the closed ends) of a stack of bags against rollers 16 so as to hold the bags firmly prior to and during dispensing of a bag, and to prevent them from falling down before being dispensed. Bar 28 presses on the stack of bags with somewhat higher pressure than required to merely hold the bags in place. The additional pressure increases friction between adjacent bags such that, when the rollers frictionally engage the bag to be dispensed, the increased friction causes asymmetrical motion between the wall of the bag engaging the roller and the wall of the bag engaging the adjacent bag in the stack. The asymmetrical motion of the walls of the bag causes partial separation of the walls from one another, so that a user can open the dispensed bag more easily.

Figure 6:
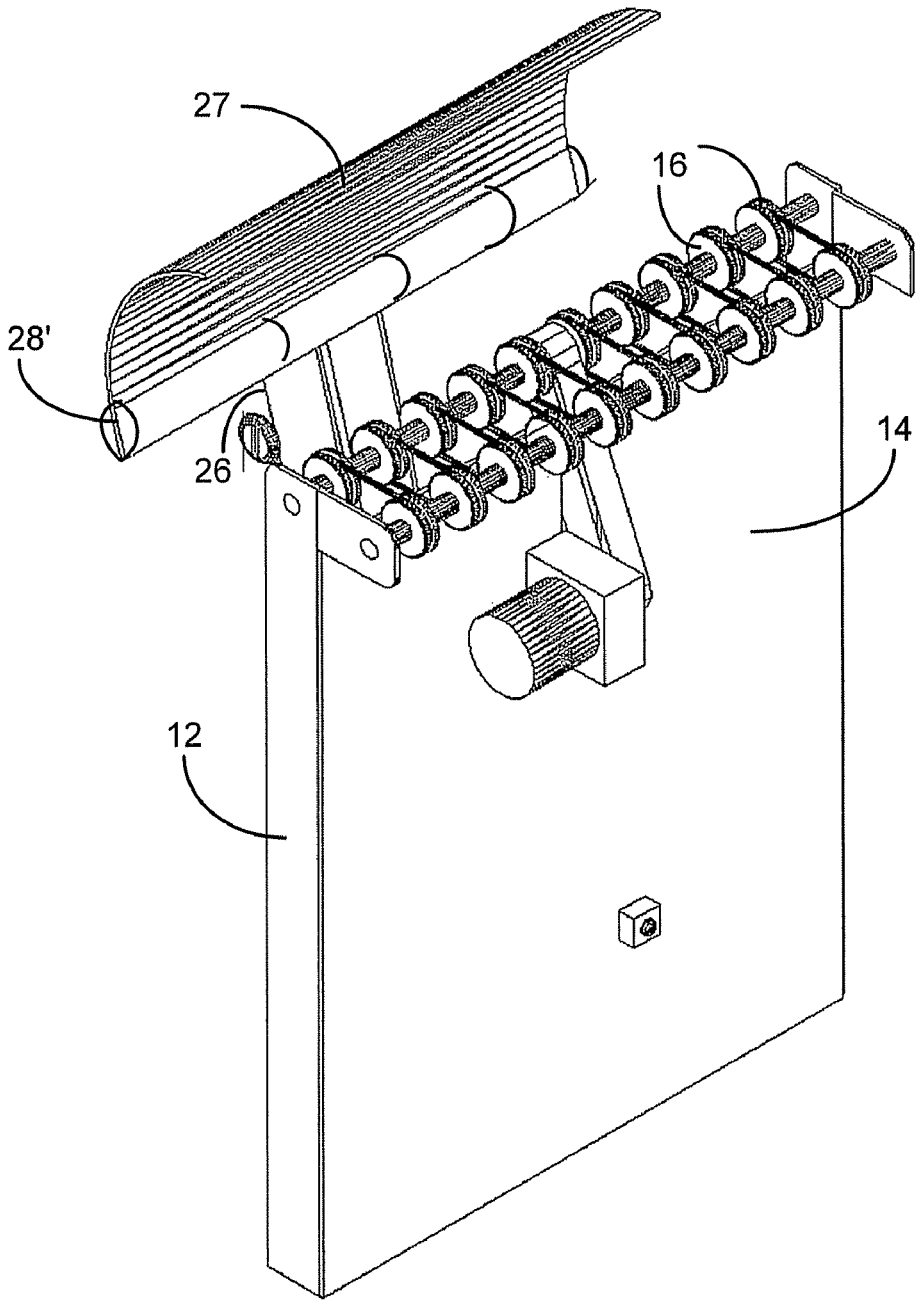
FIG. 6 is a schematic view of a device for dispensing bags constructed and operative in accordance with an alternative embodiment of the present invention.

Bar 28 is preferably substantially cylindrical, as shown in FIGS. 1 and 2. This shape provides consistent pressure on the bags at any angle of the bag-retaining arm. Optionally, a concave guide 27 can be appended to bar 28, as shown in FIG. 6. Guide 27 guides the bags over the row of rollers, so that they fall down the front of the plate, as described below.

When the bags in the stack are coupled by a frangible coupling portion having a throughgoing hole, a pin 29 may be provided on the rear surface of plate 14 for threading through the hole, so as to hold the stack of bags, and to permit ease of alignment of several stacks of bags in the device at one time. Pin 29 also serves as an opposing force for the rollers, so as to prevent the entire stack from being dispensed together. Alternatively, a clip 64 or any other means may be utilized, to hold the tops of the bags to the plate 14, as shown, for example in FIG. 9.

It will be appreciated that, while the invention has been illustrated utilizing plastic bags having two handles, by way of example only, the device for dispensing bags can be utilized with any type or design of bags, including paper bags, or plastic bags of any design It will further be appreciated that, depending upon the design of the bags, the stack of bags can be held with the tops of the bags (the openable portion) upright, rather than in the illustrated direction.

Figure 3:
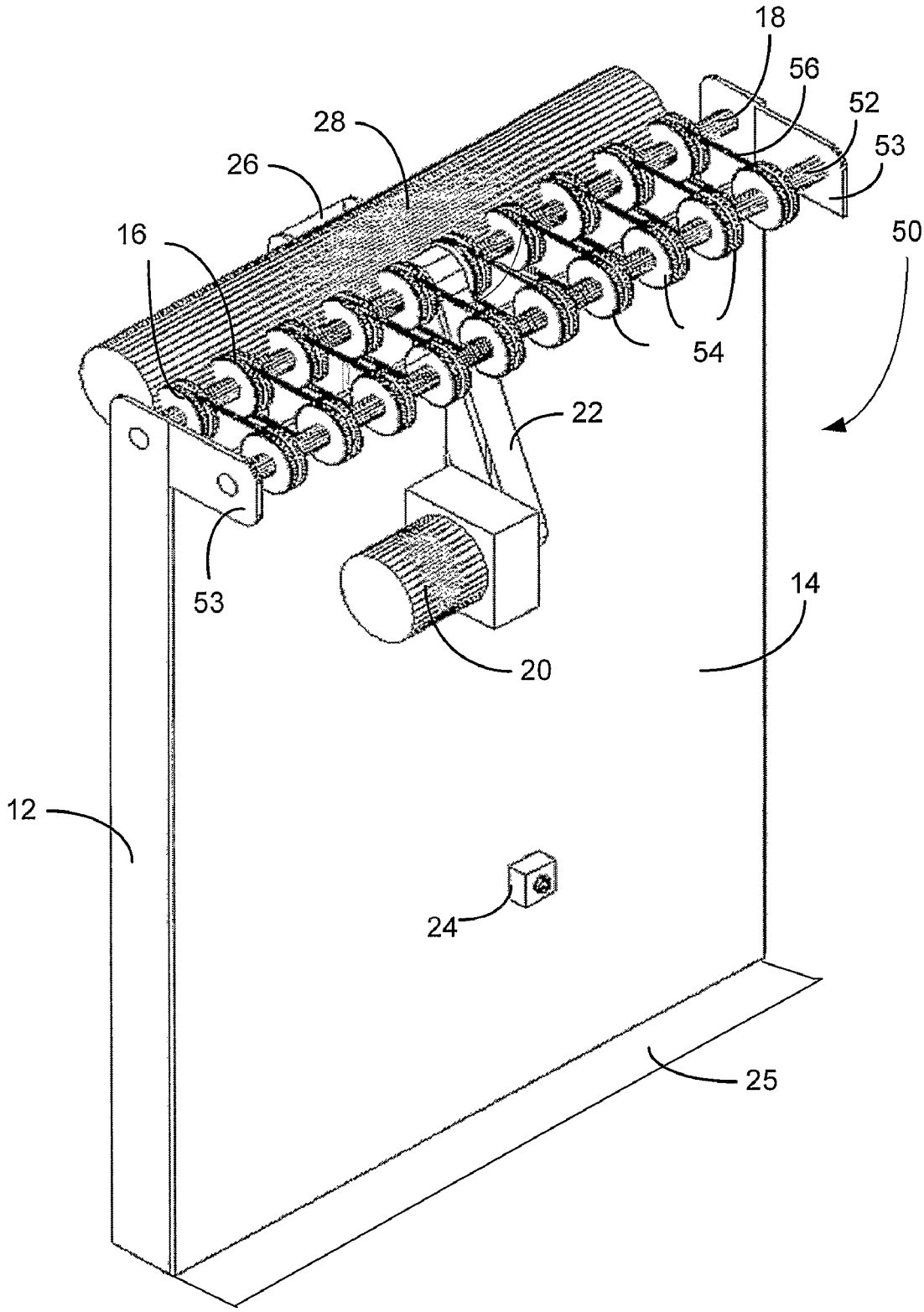
FIG. 3 is a schematic front view illustration of a device for dispensing bags constructed and operative in accordance with another embodiment of the present invention.
Figure 4:
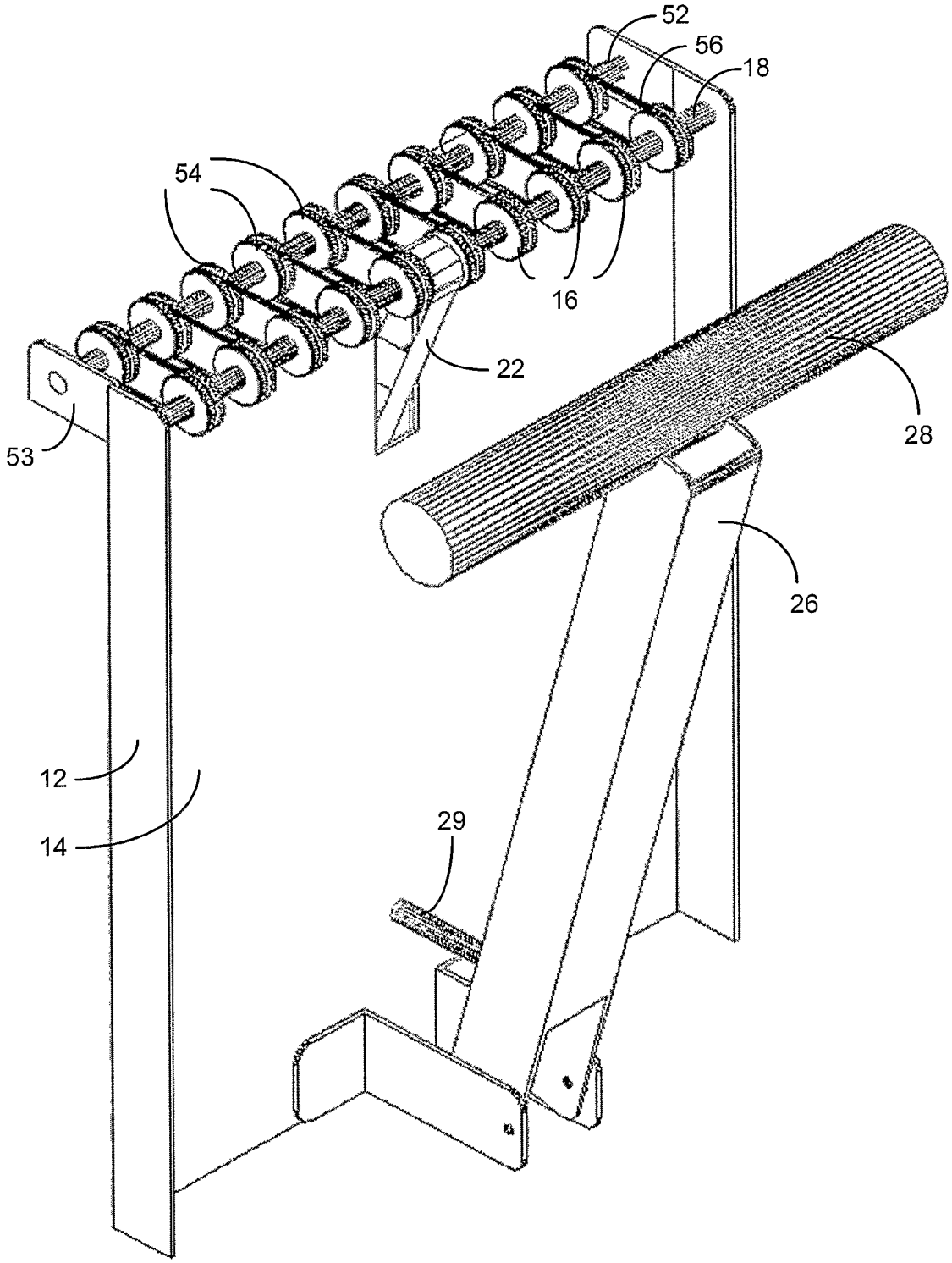
FIG. 4 is a schematic rear view of the device of FIG. 3, in a bag receiving orientation.

Referring now to FIGS. 3 and 4, there are shown schematic front and rear view illustrations of a device 50 for dispensing bags, constructed and operative in accordance with another embodiment of the present invention. Bag dispensing device 50 is substantially the same as bag dispensing device 10, and like elements have like reference numerals. Thus, bag dispensing device 50 includes a frame 12 on which is mounted a plate 14. The difference in device 50 is that frame 12 includes two extensions 53 extending perpendicular to plate 14. A second shaft 52 is rotatably mounted on extensions 53. At least one, and preferably a plurality of rollers 54 are non-rotatably affixed to second shaft 52. Each roller 16 is coupled, as by a belt 56, like a pulley, to a roller 54 in register therewith.

The addition of a second shaft, mounted parallel to the first, and coupled by belts in such a way that there is no open gap between them, ensures that a bag being dispensed cannot become entangled in or wrapped around the rollers 16 and shaft 18, thereby preventing the device from stalling or breaking down. It will be appreciated that the rollers 54 also provide additional moving force to a dispensed bag. As in the device of FIG. 1, a motor 20 is mounted on the front surface of plate 14 and drivingly coupled to shaft 18 by transmission means 22, here shown as a belt. Since each roller 16 is coupled to a roller 54, rotation of shaft 18 by the motor cause concomitant rotation of shaft 52 by rotating the rollers affixed thereto. A detector 24, such as an electric eye, is also mounted on the front surface of plate 14, in order to detect the presence of a dispensed bag.

Alternatively, other means can be mounted on plate 14 or on extensions 53 substantially adjacent to rollers 16, such that the distance between such means and rollers 16 is too narrow for a bag to pass therethrough, so as to prevent entanglement of dispensed bags in shaft 18. One example of such a means is shown in FIG. 10. As can be seen, an elongate guide plate 62 is affixed to plate 14 close to rollers 16 to guide dispensed bags away from the rollers. It will be appreciated that plate 62 may be a bent portion of plate 14.

Figure 5A:
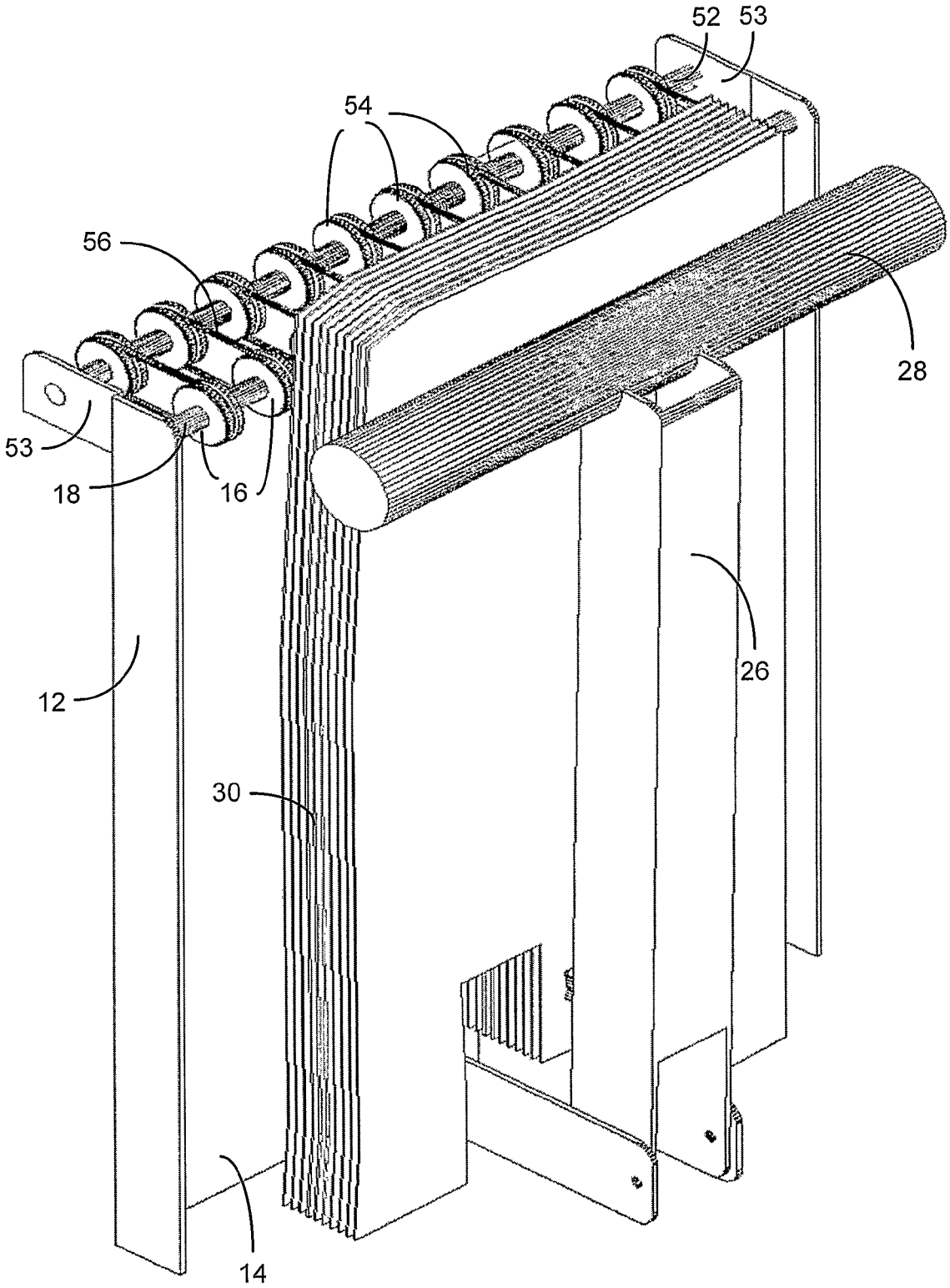
FIGS. 5*a* and 5*b* are respective rear and front views of the device of FIG. 3 ready for operation, with a stack of bags in place.
Figure 5B:
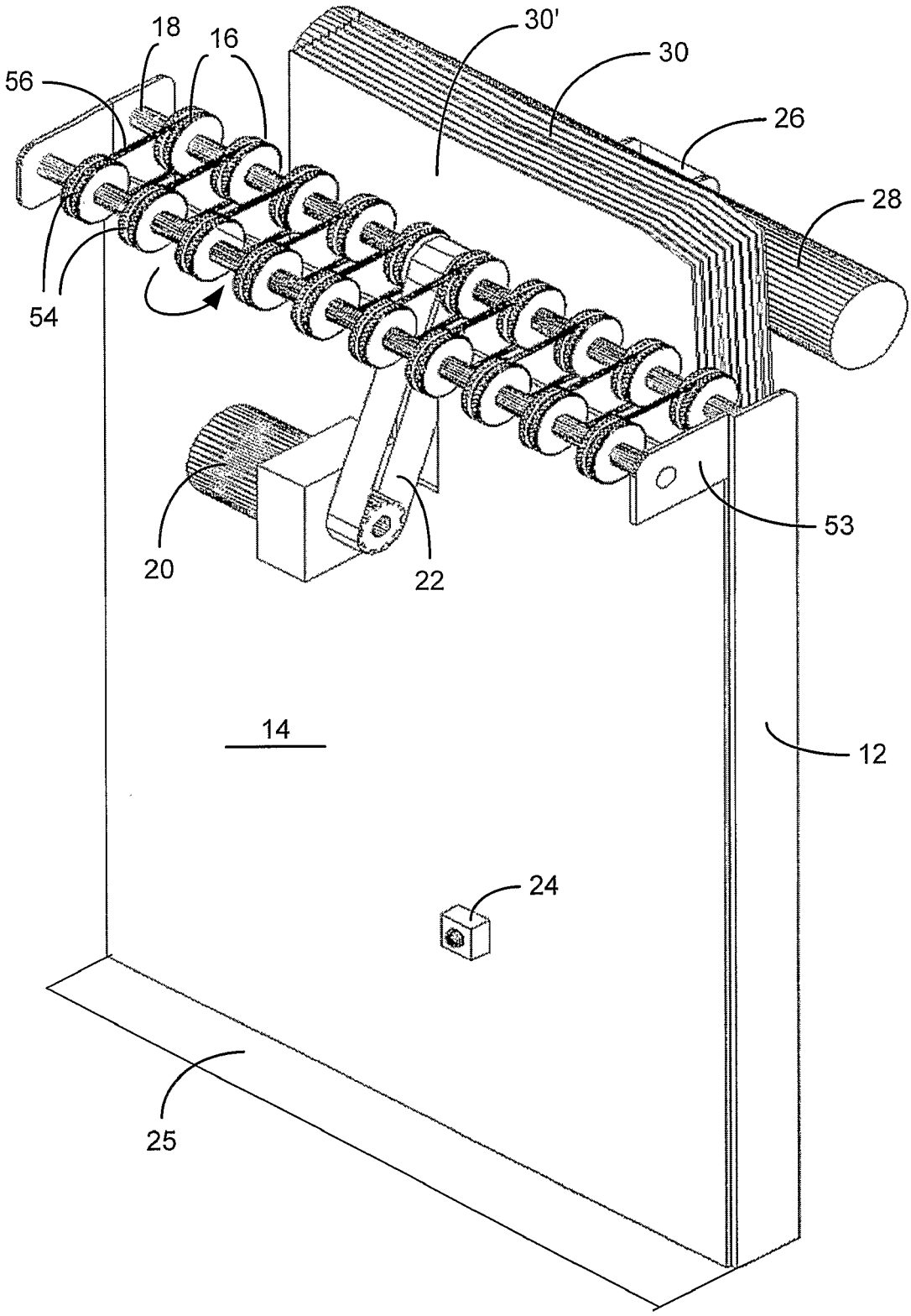

Operation of the device of the present invention will now be described with reference to the embodiment of FIG. 3, by way of example only. First, a stack of bags 30 to be dispensed is placed on plate 14, as seen in FIGS. 5*a* and 5*b*, and bag-retaining arm 26 is in a closed orientation. In this embodiment, the bags 30 are held upside down, with their bottoms engaged by bar 28, which presses the bottoms of the bags against rollers 16. In the embodiment illustrated in FIG. 5*a*, the bags have a stub near the center of the top end of the bags with a hole. Pin 29 is threaded through the holes in order to retain the tops of the bags against the pull of the rollers 16. Preferably, the stack of bags 30 is held against plate 14 such that the bottoms of the bags extend above the rollers 16, as seen most clearly in FIG. 5*b*.

According to a preferred embodiment of the invention, the device is arranged to always have one dispensed bag available for removal by a customer. Thus, when detector 24 detects the absence of a bag, it permits rotation of the shaft 18. According to a preferred embodiment, the detector is arranged to actuate motor 20 (see FIG. 5*b*). Motor 20 drives shaft 18 via transmission belt 22, causing rotation of shaft 18 and rollers 16 in the direction of the arrow. Rollers 16, in turn, cause rotation of rollers 54 in the same direction. Bar 28 presses bags 30 against rollers 16, until rollers 16 engage a rearmost bag 30' in the stack.

Rollers 16 are adapted to create friction between them and the adjacent bag 30', a friction which is greater than the friction between the bag 30' and the adjacent stack of bags pressed by bar 28, and which is sufficient to shift bag 30' over the rollers and tear it from the central portion on pin 29, or other means which holds it from the other side. The remaining bags 30 are held by both bar 28 and pin 29 (or other retaining element), so they are not lifted together with bag 30'.

Figure 5C:
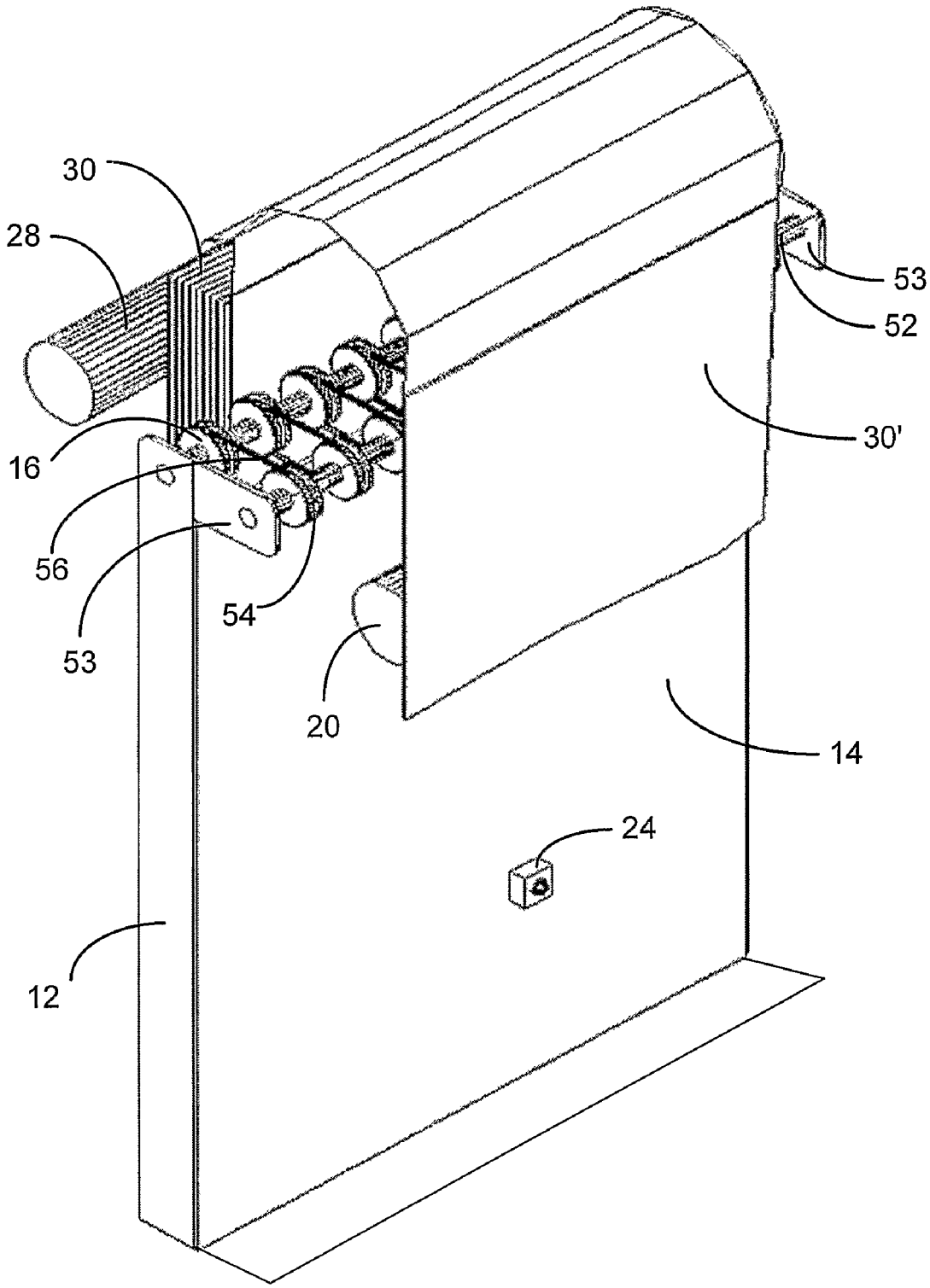
FIG. 5*c* is a front view of the device of FIG. 5*a*, showing a stage of dispensing a bag.

Bag 30' continues to be shifted by, and over rollers 16 and rollers 54, as shown in FIG. 5*c*, so that it falls down along the front surface of plate 14. While a single row of rollers 16, as shown in the embodiment of FIG. 1, is sufficient to provide this action, a double row of rollers as seen in FIG. 5*c* increases the reliability of the device and ensures that the bags do, indeed, continue down over the motor and the transmission belt and do not become wrapped around the rollers.

According to a preferred embodiment of the invention, rod 28' is equipped with an elongated concave guide member 27 mounted on arm 26, as shown in FIG. 6. Guide member 27 guides bag 30' to bend over rollers 16 and 54 and descend down the front surface of plate 14.

It is a particular feature of the invention that, once a bag has been dispensed and falls down from the stack, rotation of the shaft and, consequently rotation of the rollers is stopped. This can be accomplished in a variety of ways, e.g., by electronically stopping rotation of the motor, or by mechanically stopping rotation of the shaft and simultaneously electronically stopping the rotation of the motor, or stopping the transfer of power to the shaft from the motor, as by means of a clutch (not shown), or in any other fashion. In the embodiment of FIGS. 5*a*-5*d*, when the detector 24 detects the presence of a bag, the detector causes operation of the motor to stop, as by electronic relays (not shown), so that only a single bag is dispensed at a time. A timer can be introduced into the electric circuit that energizes the motor, which can be pre-set to allow rotation and stoppage of the shaft at a pre-determined rate. In this case, the timer, or other delay means, can be utilized to provide a pause between bag dispensing. Or, if desired, the speed of the motor can be controlled for increasing or decreasing the time span between dispensed bags.

Figure 5D:
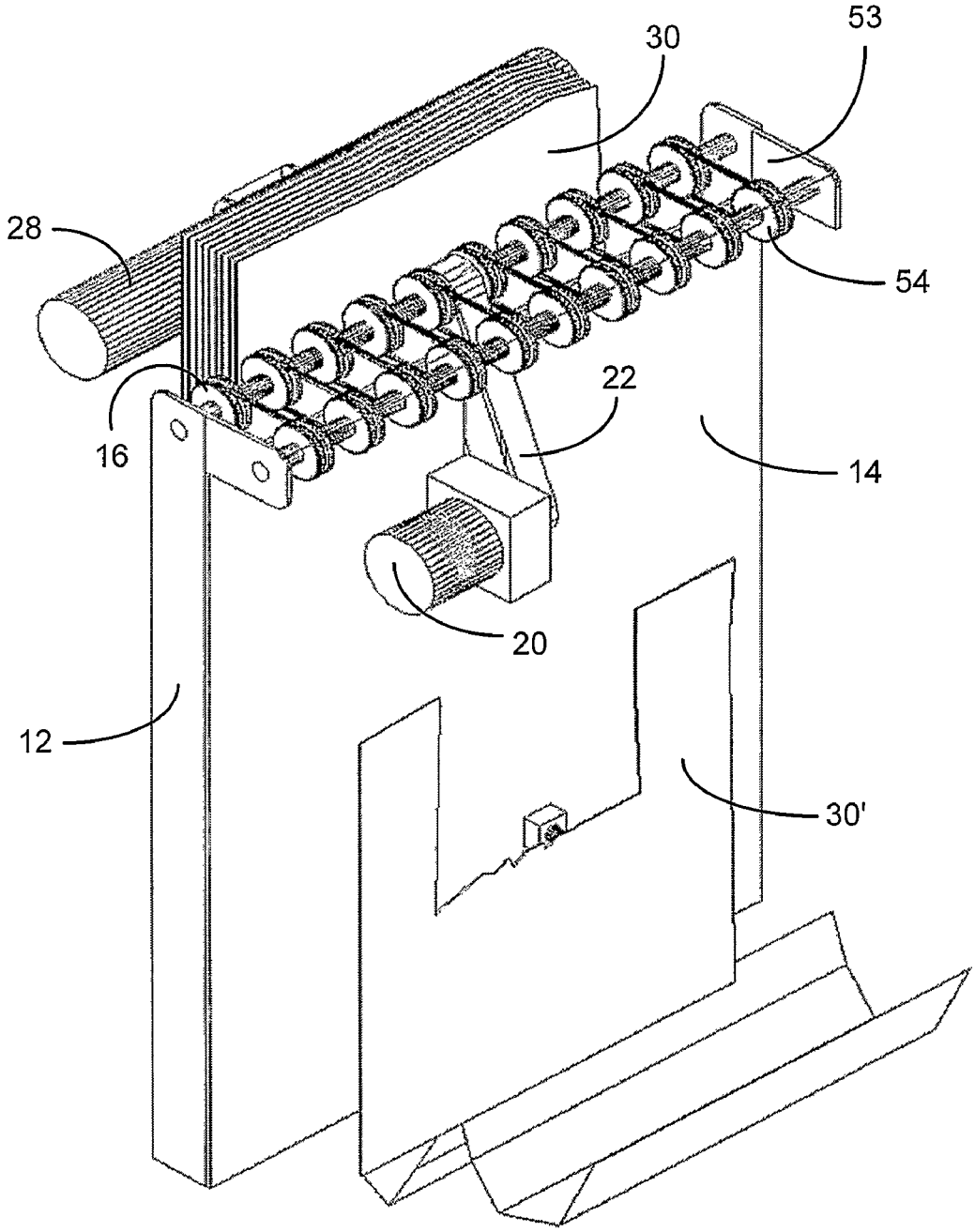
FIG. 5*d* is a front view of the device of FIG. 5*a*, showing a single dispensed bag awaiting removal.

The dispensed bag falls down in front of the detector, as seen in FIG. 5*d*, and is available for use at any time. It is a particular feature of the invention that plate 14 bars a user from reaching the stack of bags. Thus, a user taking dispensed bag 30' from the front of the device is unable to reach or remove additional bags from the stack. Rather, he must remove the dispensed bag, and wait while the detector, and optionally the timer actuate the motor to dispense another bag, in order to take a second bag. According to yet another feature of the present invention, the user is unable to remove a bag during the dispensing process, but only after it has fallen from the rollers at the end of the process.

Figure 7:
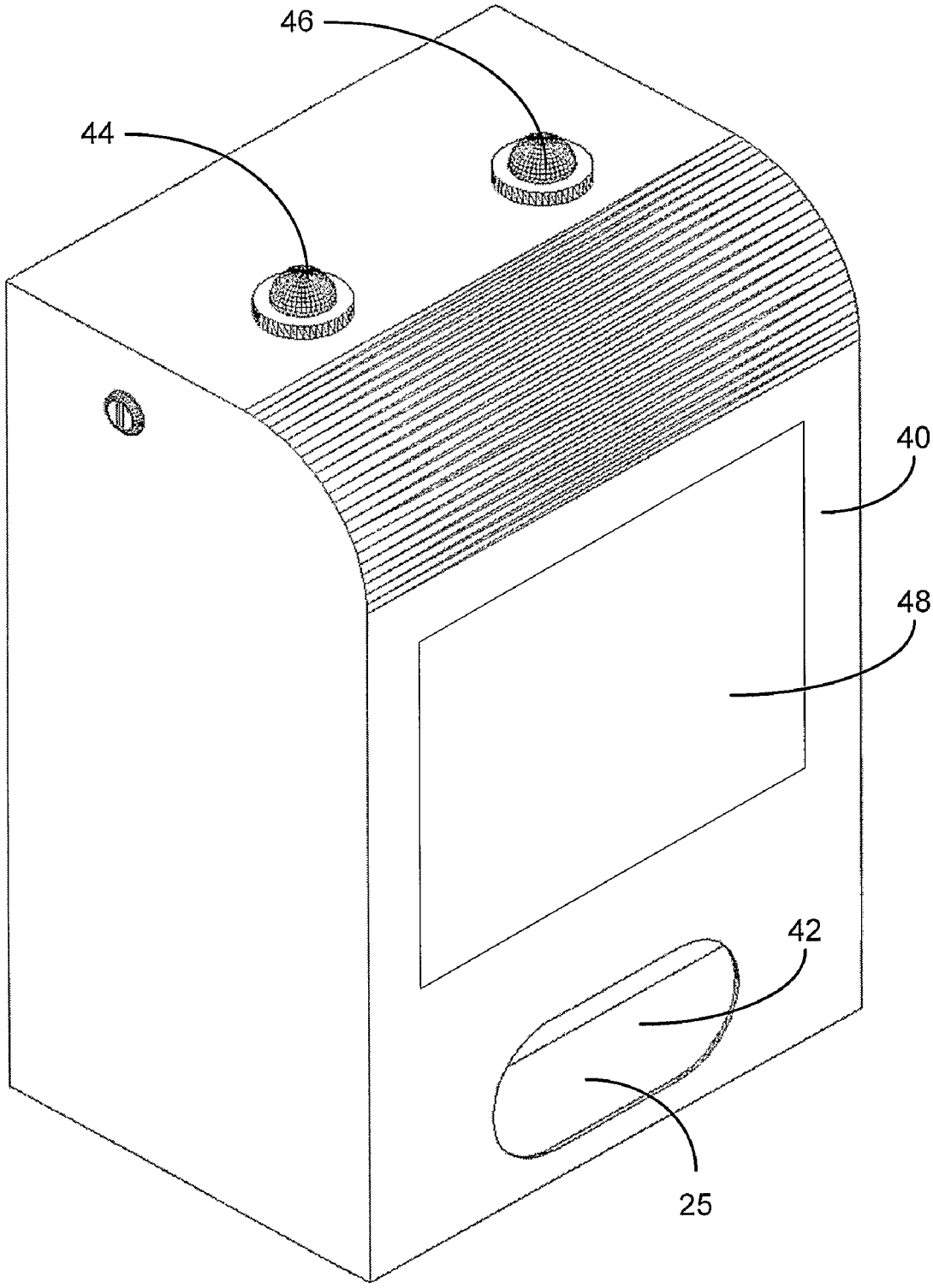
FIG. 7 is a perspective view of housing for a device for dispensing bags according to one embodiment of the invention.
Figure 8:
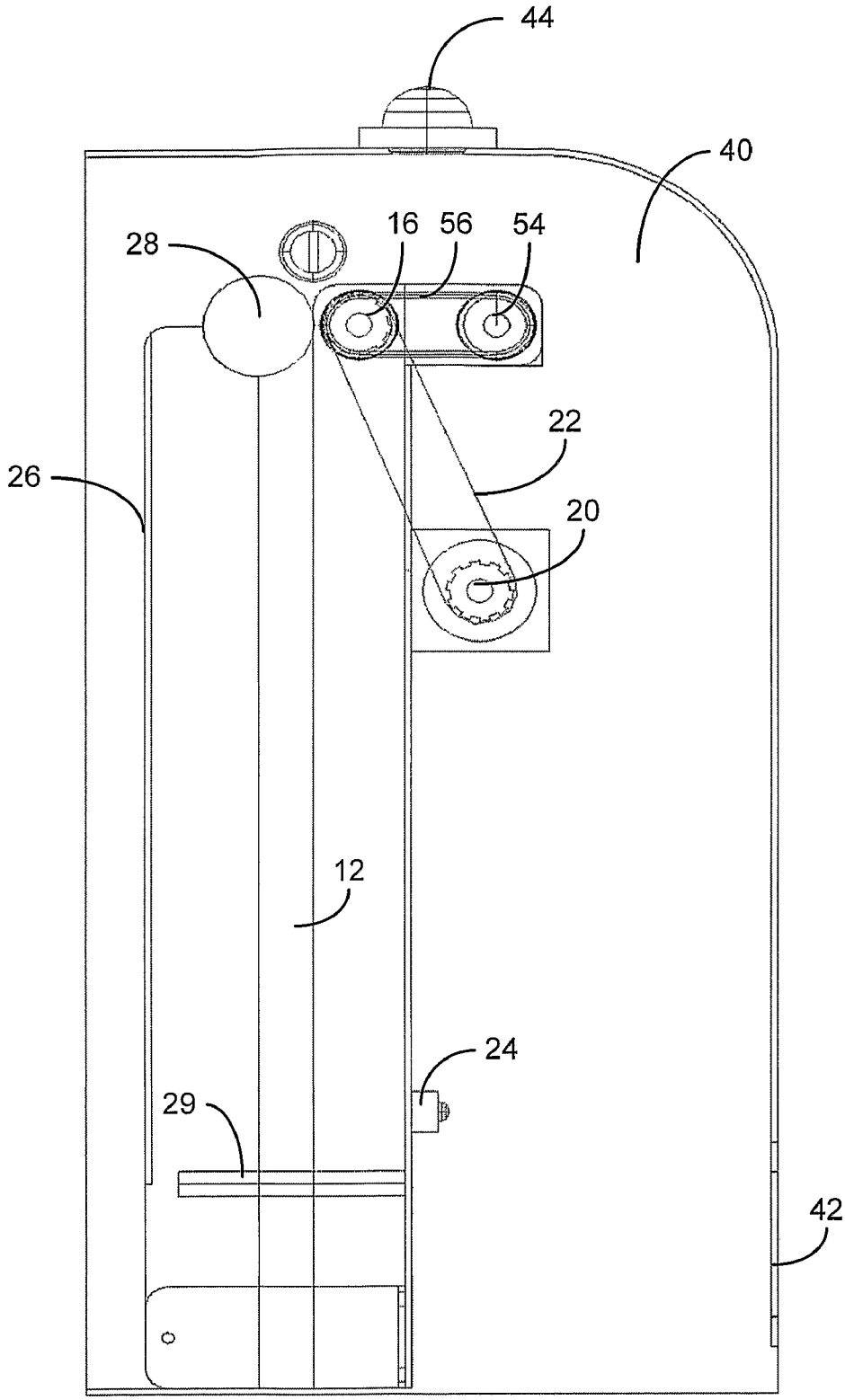
FIG. 8 is a schematic side sectional view of the housing of FIG. 7 with a device for dispensing bags according to the present invention mounted therein.

Preferably, the device of the present invention is mounted in housing. One example of suitable housing 40 is shown in FIGS. 7 and 8. As can be seen, housing 40 can be a simple box of sufficient size to house the device, and having an opening 42 adjacent to the front surface of plate 14 to permit retrieval of a dispensed bag. Opening 42 may be provided with a cover, if desired, although this is not necessary. A number of indicators 44, 46 may be provided on the housing. One indicator 44 can indicate when the device is on standby, i.e., coupled to a power source and waiting with a dispensed bag. Another indicator 46 can be used to indicate that all bags in the device have been dispensed, or when only a pre-selected small number of bags remain, so as to permit prompt replacement of a full stack of bags. Needless to say, the housing can be opened or removed in order to insert a new stack of bags, or for other maintenance.

Figure 12:
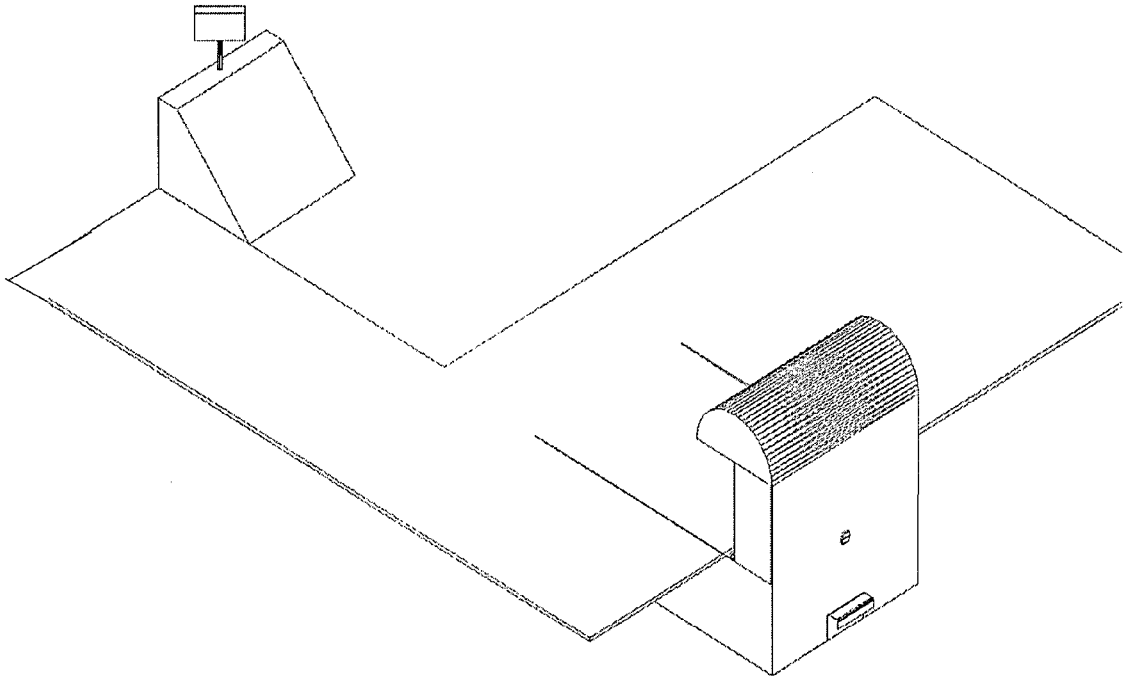
FIG. 12 is a schematic illustration of a device according to the invention mounted under the counter in a store.

It will be appreciated by those skilled in the art that, while the invention has been illustrated mounted in a vertical orientation, alternatively, the device can be mounted horizontally. In this case, the bags being dispensed will be provided with an additional mechanism suitable for moving each bag removed from the stack upward over the counter for dispensing on the counter, while preventing access by the user to the stack. For example, the device can be mounted under the counter in a store, as shown schematically in FIG. 12, and the dispensed bags will fall onto the counter for use by the customer.

According to one embodiment of the invention, the device can be coupled to a cash register in the store, so as to control the number of bags dispensed per customer and to charge the customer for the bags used, if desired. In this case, the device further includes a controller (not shown) to control and monitor the device, and for communication with the cash register or central store computer. The controller may comprise a CPU and a memory unit or a complete processor, as known in the art. Thus, an electronic connection of any technique can be provided coupling the register with the controller, so as to permit communication between the two. Thus, a wired or wireless connection can be provided for control and/or monitoring of the bag dispensing device by the cash register or central computer of the store via the register. Consequently, the controller can be used to permit the cashier to cause the device to dispense a desired number of bags, i.e., a number paid for in advance by the customer, or to which he is entitled, due to the quantity and size of his or her purchases. In addition, the controller can be used to collect data, e.g. count the number of bags used and/or remaining in the stack, for purposes of stock control, budgeting, accounting, and the like.

According to a further embodiment of the invention, the controller can be programmed to determine the number of bags required by each customer, depending upon the goods he or she has purchased. Such a program could determine the required number of bags by providing the controller with data of, for instance, the categories of goods (heavy, large, small, food or cleaning supplies, etc.) and the number of units per each category. Alternatively, the register could include such a program for automatically determining the number of required bags, and cause the device to dispense that number. An option can be provided for the cashier to indicate if the customer is elderly or has a physical limitation requiring lighter than normal packing (i.e., requiring a larger number of bags.)

According to another embodiment, housing 40 may include a display 48, which can be used to provide informative messages to shoppers or for advertising purposes. According to one embodiment, the display is a conventional frame, pocket, or light box, into which a suitable advertising poster or removable advertising materials can be inserted. Alternatively, the display can be an electronic display having a controller for periodically changing the advertisement displayed thereon. If the device includes a controller, the same controller can be used also to control the electronic display. According to one embodiment, the display is coupled to the main computer of the store in which it is used, so the content displayed thereon can be monitored and controlled by responsible parties in the store.

Figure 9:
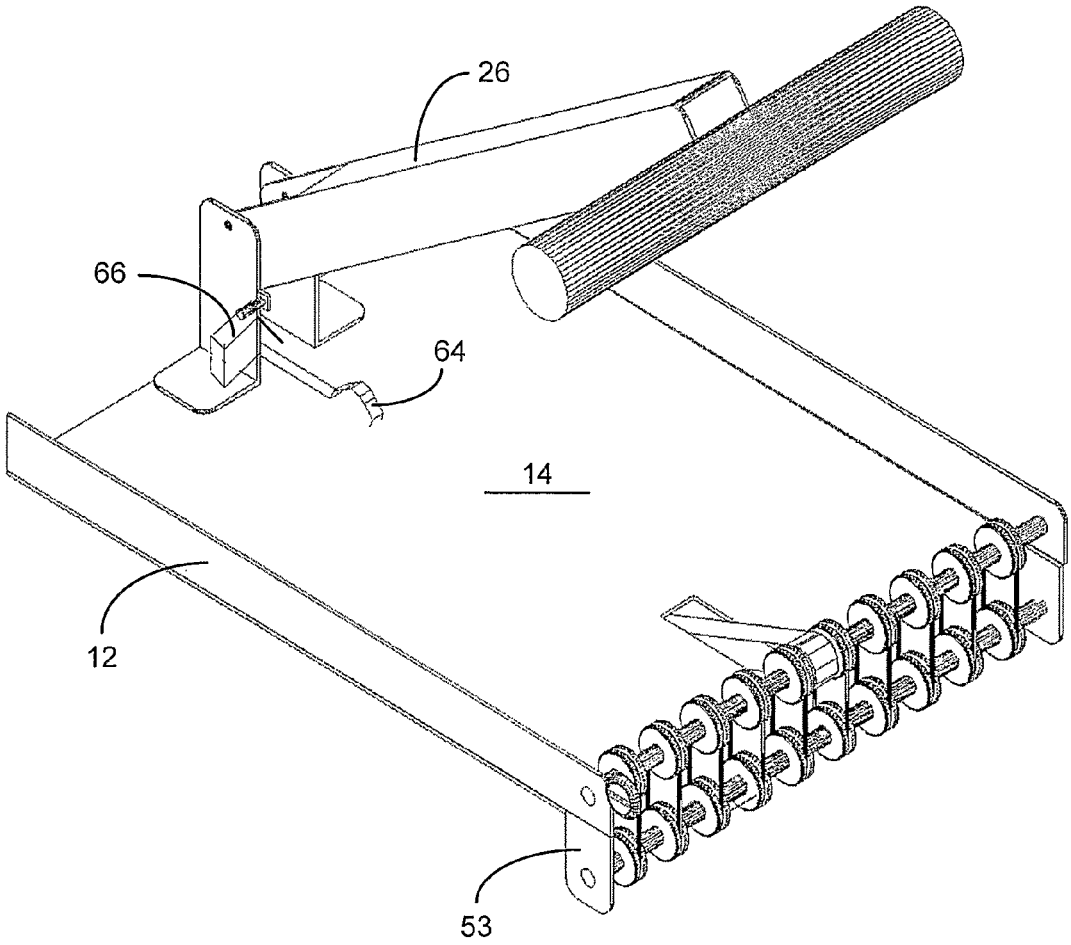
FIG. 9 is a schematic view of a device for dispensing bags constructed and operative in accordance with a further embodiment of the present invention.

According to another embodiment, shown in FIG. 9, a sensor 66 can be provided on frame 12 or on bag-retaining arm 26, or in any other location on the device, to determine the quantity of bags remaining in the stack. In the embodiment of FIG. 9, sensor 66 is a micro-switch, which is actuated by the passage of arm 26 along the switch beyond a pre-set threshold. Once the quantity of bags falls below the pre-set threshold, an audible signal may be provided, and/or indicator 46 will light up, to indicate to an operator that a new stack of bags will be required shortly.

Figure 11:
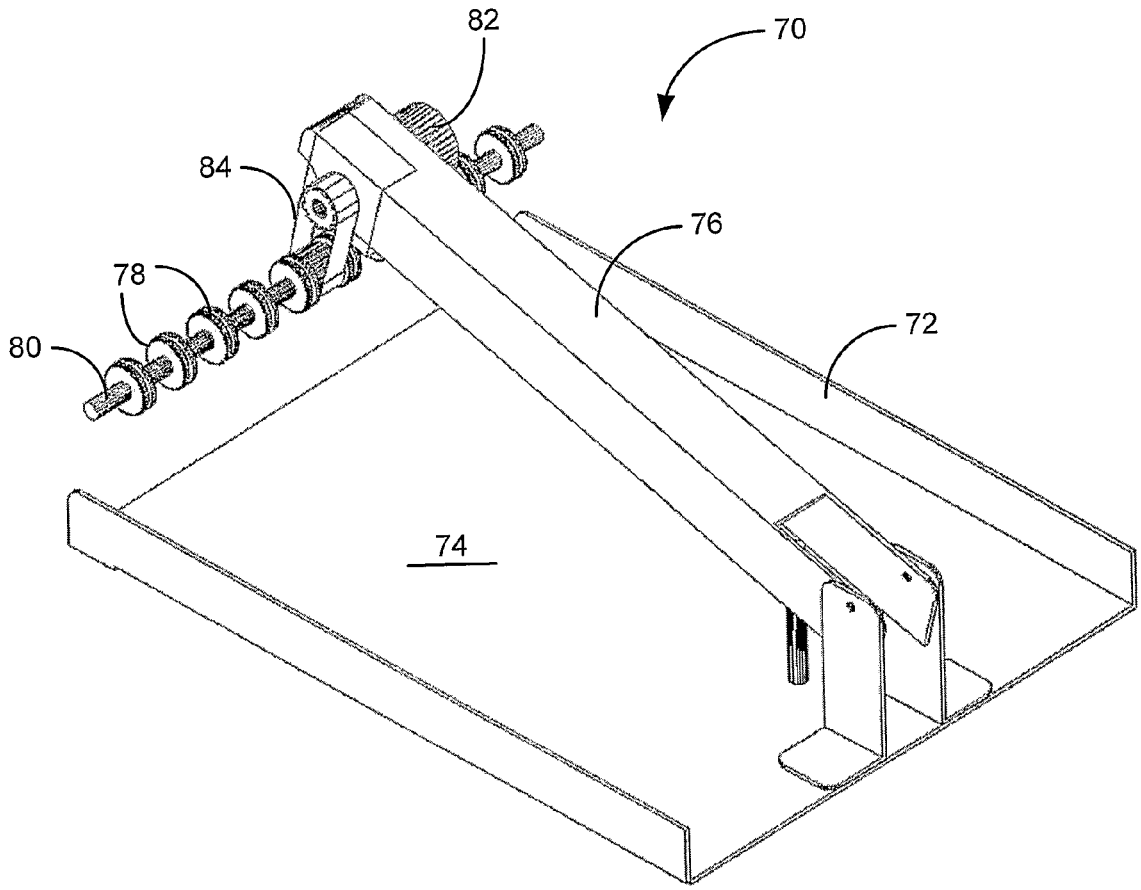
FIG. 11 is a schematic view of a device for dispensing bags constructed and operative in accordance with yet another embodiment of the present invention.

It will be appreciated that means other than a motor can be utilized to cause rotation of shaft 18. According to one alternative embodiment of the invention, shown in FIG. 10, the means for rotating shaft 18 can be a handle 60, or any other manual means of causing rotation of shaft 18. In this case, an electromechanically actuated bolt 68 is provided for stopping the rotation of the shaft 18 following the dispensing of each bag. Bolt 68 can be controlled by detector 24 to lock shaft 18 by actuating the bolt to engage a toothed wheel 69 mounted non-rotatably on shaft 18. Bolt 68 disengages toothed wheel 69 and permits rotation of shaft 18, when the dispensed bag has been retrieved by the user. Referring now to FIG. 11, there is shown a schematic view of a device 70 for dispensing bags constructed and operative in accordance with a further embodiment of the present invention. Bag dispensing device 70 includes a frame 72 on which is mounted a plate 74. In this embodiment, the front surface of plate 74 serves as a planar bag-supporting surface, and a bag-retaining arm 76, preferably spring-biased in a closed orientation, is also provided on the front surface of plate 74 for holding a stack of bags against the plate. In the embodiment of FIG. 11, at least one, and preferably a plurality of rollers 78 are non-rotatably affixed to a shaft 80, which is rotatably mounted on top of arm 76. Means for rotating shaft 80 are illustrated, in the embodiment of FIG. 11, as a motor 82 mounted on the bag-retaining arm 76. Shaft 18 is driven by motor 82 by a power transmission means 84, such as a belt. According to this embodiment of the invention, the rollers 78 move the uppermost bag of the stack beyond the top portion of plate 74 by the friction resulting from their rotation and engagement with that bag.

It will be appreciated that, in this embodiment, the row of rollers 78 serve, when arm 76 is in the closed orientation, to press one end of a stack of bags against plate 74, so as to hold them firmly in the device prior to and during dispensing of a bag, and to prevent them from falling down before being dispensed.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims, which follow.

The invention claimed is:

1. A device for dispensing a bag from a stack of bags, the device comprising:

a plate mounted on a frame, said plate defining a planar bag-supporting surface and an opposite planar surface;

a rotatable shaft coupled to said frame;

at least one roller non-rotatably affixed to said shaft and arranged to engage a bag of the stack of bags nearmost said planar bag-supporting surface; means for rotating said shaft whereby said nearmost bag is shifted over said at least one roller;

a bag detector coupled to the means for rotating said shaft, such that when the bag detector detects the presence of a bag, the rotatable shaft stops rotating, wherein the stack of bags is held against said planar bag-supporting surface, and when said rotatable shaft rotates, said nearmost bag is thereby dispensed to said opposite planar surface side of said plate, said plate being disposed between said dispensed nearmost bag and the stack of bags, and wherein said rotatable shaft is mounted on said frame, and the device further comprises a bag retaining element coupled to said plate for pressing the stack of bags against said at least one roller, said bag retaining element having a first end and a second end, said first end of said bag retaining element being pivotally connected to said plate.

2. The device according to claim 1, further comprising an elongate guide mounted adjacent said rollers to guide dispensed bags away from the rollers.

3. The device of claim 1, wherein the bag retaining element is biased toward a closed orientation with respect to the plate.

4. The device according to claim 1, wherein the plate is vertically mounted to the frame.

5. A device for dispensing a bag from a stack of bags, the device comprising:

a plate vertically mounted on a frame, said plate defining a planar bag-supporting surface and an opposite planar surface;

a first rotatable shaft mounted on top of said frame;

a second rotatable shaft mounted parallel to said rotatable shaft on an extension of said frame, wherein said extension is attached to the frame and extends away from the plate;

at least one roller non-rotatably affixed to said first rotatable shaft and arranged to engage a bag of the stack of bags nearmost said planar bag-supporting surface; means for rotating said first rotatable shaft whereby said nearmost bag is shifted over said at least one roller;

at least one roller non-rotatably affixed to said second rotatable shaft;

wherein each roller on said first rotatable shaft is coupled to a roller on said second rotatable shaft, whereby rotation of said first rotatable shaft causes concomitant rotation of said second rotatable shaft, and said first rotatable shaft is disposed between said second rotatable shaft and a bag retaining element; and a bag detector coupled to the means for rotating said first rotatable shaft, such that when the bag detector detects the presence of a bag, the first rotatable shaft stops rotating, wherein the stack of bags is held against said planar bag-supporting surface, and when said first rotatable shaft rotates, said nearmost bag is shifted over said at least one roller and descends down along said opposite planar surface side of said plate, said plate being disposed between said dispensed nearmost bag and the stack of bags.

6. The device according to claim 5, further comprising a bag retaining element that includes a bag-retaining bar for engaging and retaining said stack of bags against said at least one roller before and during dispensing.

7. The device according to claim 6, wherein said bag-retaining bar is coupled to an arm pivotally coupled to said plate.

8. The device according to claim 6, wherein the bag retaining element is biased toward a closed orientation with respect to the plate.

9. The device according to claim 5, further comprising an elongate guide mounted adjacent said rollers to guide dispensed bags away from the rollers.

* * * * *